US006629514B1

(12) United States Patent
Gale

(10) Patent No.: US 6,629,514 B1
(45) Date of Patent: Oct. 7, 2003

(54) TWO STROKE GASOLINE ENGINE WITH ROTARY VALVE ENABLING DOUBLE ACTING POWER STROKES AND ROTARY AIR VALVE TO LESSEN BLOWBACK

(76) Inventor: Richard A. Gale, P.O. Box 864, Vineyard Haven, MA (US) 02568

( * ) Notice: Subject to any disclaimer, the term of this patent is extended or adjusted under 35 U.S.C. 154(b) by 0 days.

(21) Appl. No.: 09/603,463

(22) Filed: Jun. 22, 2000

Related U.S. Application Data

(60) Provisional application No. 60/140,393, filed on Jun. 22, 1999.

(51) Int. Cl.[7] ..... F02B 75/18

(52) U.S. Cl. ..... 123/65 R; 123/55.2

(58) Field of Search ..... 123/65 R, 55.2, 123/55.7, 55.5

(56) References Cited

U.S. PATENT DOCUMENTS 2,404,906 A * 7/1946 Heald ..... 74/50
2,495,445 A * 1/1950 Crenshaw ..... 103/163
2,610,615 A * 9/1952 Butterfield ..... 123/56
5,503,038 A * 4/1996 Aquino et al. ..... 74/49
5,934,229 A * 8/1999 Li et al. ..... 123/55.5

* cited by examiner

*Primary Examiner*—Tony M. Argenbright
*Assistant Examiner*—Katrina B. Harris
(74) *Attorney, Agent, or Firm*—Robert T Dunn, Esq.

(57) ABSTRACT

A piston mechanism for gas driven engines, fluid motors, pumps and the like that has a piston in a chamber that is moveable in the chamber in a reciprocating action and a rotating shaft that is driven by or drives the piston, wherein a double eccentric drive mechanically connects the piston and the drive shaft and the double eccentric drive has a minor eccentric engaged by a minor internal gear that is fixed to the inside of the piston, which converts the piston reciprocating drive motion to an orbiting axle of the minor eccentric and a major eccentric that engages a major internal gear that is fixed to the outside of the chamber and carries the output drive shaft, and the eccentrics are connected at their orbiting axles so that the major eccentric converts the orbiting motion of the minor eccentric axle to a rotational motion of the drive shaft.

13 Claims, 12 Drawing Sheets

TWO STROKE GASOLINE ENGINE WITH ROTARY VALVE ENABLING DOUBLE ACTING POWER STROKES AND ROTARY AIR VALVE TO LESSEN BLOWBACK

BACKGROUND OF THE INVENTION

The applicant herein claims the benefit of the filing date of the applicant's U.S. Provisional Application Ser. No. 60/140,393, filed Jun. 22, 1999.

This invention relates to reciprocating piston devices such as: internal combustion engines, fluid motors and pumps; and more particularly to the rotating shaft drive from or to such devices and the integration of the reciprocating piston, rotating drive shaft and valves of a double acting, two stroke gasoline engine embodiment thereof.

Heretofore two stroke engines have had a conventional crankshaft arrangement of piston and piston rod connected to the crankshaft to provide a drive train that converts the reciprocating drive of the piston into output shaft rotation. This conventional crankshaft arrangement of piston and piston rod connected to a crankshaft has been replaced by a number of mechanisms. Some of these mechanisms require the use of sliders and others require the use of two orthogonal pistons.

Double acting engines have been provided using a modified piston rod and crankshaft arrangement by locating both inside the piston and providing a transmission opening through two opposite sides of the piston for the crankshaft, which is carried by bearings on the outside of the piston chamber. These modifications also require a slider for the crankshaft bearing connection to the piston and an opening through the transverse opposite sides of the piston.

In two stroke type gasoline engines the piston periodically covers and uncovers openings known as ports in the cylinder wall (the two stroke engine is seldom equipped with valves). The operation of the two stroke engine of the type provided with a scavenging fan begins at the start of the first stroke where the piston is in its high position. When the compressed gasoline-air mixture over the piston is ignited, the piston thrusts downward and in so going releases (uncovers) the exhaust port. The burned gasses (exhaust) in the cylinder which are still under high pressure can then escape through the exhaust port. When the piston descends further, its upper edge releases (uncovers) the inlet port which admits fresh gas-air mixture into the cylinder so that the remaining burned gasses (exhaust) are flushed out. When the piston rises again (second stroke), all of the ports are closed (covered) for a time and during this period, the gas-air mixture is compressed, so that a new cycle can begin.

The crankcase scavenged two stroke engine has no scavenging fan. Instead, the crankcase is hermetically sealed so that it can function as a pump in conjunction with the piston. When the piston ascends, a partial vacuum is produced in the crankcase, until the lower edge of the piston releases the inlet port and thus, opens the way to the fresh gas-air mixture into the crankcase. When the piston descends, the mixture in the crankcase is compressed a little so that, as soon as the top of the piston releases the transfer port and overflow duct (connecting the crankcase to the cylinder), it can enter the cylinder. Meanwhile what happens above to the piston is the same as in the fan-scavenged engine.

In the crankcase scavenged two stroke engine, the fan adds to the costs. However as the overflow duct between the cylinder and the crankcase can be provided with forced-oil lubrication without involving a risk that the oil in the crankcase can find its way into the cylinder. In the less expensive crankcase scavenged engine the lubricating oil is mixed with the gasoline or is, alternatively, supplied to the points of lubrication drop-wise by small lubricating oil pumps. The oil which enters the crankcase is liable to be carried through the overflow duct and transfer port into the cylinder, whence it passes through the exhaust port and into the exhaust system where it may manifest itself as blue smoke in the exhaust.

SUMMARY OF THE INVENTION

It is an object of the present invention to provide a gas driven engine having a double acting piston in a chamber that is driven in a reciprocating motion with a drive train from the piston to the power output drive shaft wherein the drive train is carried inside the piston and through the chamber wall to the power output drive shaft, at a part of the chamber wall that is covered throughout the engine cycle of operation.

It is a further object that the drive train exposure to the driving gas be minimized.

It is another object to provide a double acting or two cycle gas driven engine with a piston in a chamber engaging and output drive shaft through a side wall of the chamber, perpendicular to the piston motion using an eccentric gear train that converts the reciprocating motion of the piston to rotational motion of the output power drive shaft.

Another object of the invention is to provide a reciprocating piston mechanism that does not require the conventional crankshaft arrangement of piston and piston rod connected to the crankshaft.

According to features of the present invention, a piston mechanism for gas driven engines, fluid motors, pumps and the like is adapted with a double eccentric drive from the piston to the output drive shaft that is contained inside the piston and through a part of the piston chamber wall that is covered throughout the engine cycle of operation, so that the drive is not exposed to the piston driving gases. In preferred embodiments, the double eccentric drive has a minor eccentric engaged by the minor internal gear that is fixed to the inside of the piston, which converts the piston reciprocating drive motion to an orbiting axle of the minor eccentric and a major eccentric that engages an the major internal gear that is fixed to the outside of the chamber and carries the output drive shaft, and the eccentrics are connected at their orbiting axles so that the major eccentric converts the orbiting motion of the minor eccentric axle to a rotational motion of the output drive shaft. In particular embodiments, orbiting axle of the minor eccentric and an orbital axle of the major eccentric are connected by gears that engage the minor internal and the major internal gears and these gears are referred to herein as the minor and major pinion gears, respectively.

Specific examples incorporating features of the invention provide a housing that contains the chamber, piston, double eccentric drive and output drive shaft, the output drive shaft and major eccentric internal gear are concentric and are carried by said housing, the output drive shaft being rotatable therein, the minor eccentric internal gear is carried by said piston and the major and minor pinion gears are fixed to the orbiting axles of the minor and major eccentrics, respectively.

In an engine according to the present invention having input and output (exhaust) gas flow ports, the piston periodically covers and uncovers openings (the ports) in the chamber. In operation, when the compressed gasoline-air mixture over the piston is ignited, the piston thrusts downward and in so going uncovers the exhaust port. The burned gasses (exhaust) in the cylinder which are still under high pressure can then escape through the exhaust port. When the piston descends further, its upper edge uncovers the inlet port which admits fresh gas-air mixture into the cylinder so that the remaining burned gasses (exhaust) are flushed out. When the piston rises again (second stroke), all of the ports are covered for a time and during this period, the gas-air mixture is compressed, so that a new cycle can begin.

Among the objects of the present invention are also the following: to provide a double acting four cycle internal combustion engine that provides the four stroke cycle at both ends of the piston; to provide the forced lubrication by means of the minor eccentric and piston vanes located within to cause a pumping action of the lubricant; to provide a reciprocating piston mechanism for fluid motors and pumps having a single or double acting capability and; to provide two or more chambers arranged in suitable manner so as to achieve multiple strokes.

A further object is to provide a two cycle internal combustion engine that eliminates the need for the conventional crankcase scavenged air and the lube oil entrainment and emission problems associated therewith.

A further object is to provide a two cycle internal combustion engine that utilizes a rotary valve for air admission to both compression and combustion ends of the chamber, reducing the problem of 'blowback' that occurs with conventional 'ported' two cycle engines. However this does not preclude the use of porting only where less expensive smaller engines must be used.

A further object is to provide a two cycle engine that is double acting having power strokes at both ends of the piston and in which the engine is aspirated by other means, or is self aspirating, thus providing two power strokes per revolution of the drive shaft.

A further object is to provide a double acting four cycle internal combustion engine that provides the four stroke cycle at both ends of the piston.

A further object is to provide the forced lubrication by means of the minor eccentric and piston vanes located within to cause a pumping action of the lubricant.

A further object is to provide a reciprocating piston mechanism for fluid motors and pumps having a single or double acting capability.

A further object is to provide two or more chambers arranged in suitable manner so as to achieve multiple strokes.

According to embodiments of the present invention, a piston mechanism for internal combustion engines, fluid motors pumps and the like, has a double eccentric drive including a major and minor eccentric, perpendicular to the piston motion that is caused to rotate by means of a gear train and connected in such a manner to the piston as to impart a reciprocating action to the piston in the chamber. Each eccentric drive includes an internal gear and a pinion gear. The gear ratios of the internal gear to the pinion gear in both the major and minor eccentrics is 2:1 and the position and attitude of the piston is positively controlled by the gears and is independent of the forces between the piston and the chamber wall.

BRIEF DESCRIPTION OF THE FIGURES

FIG. 13A illustrates the minor eccentric system carried in the piston when the piston is at top dead center; FIG. 13B illustrates the major eccentric system carried in the housing when the piston is at top dead center; and FIG. 13C illustrates the major eccentric and output drive shaft at that same piston position.

These and other embodiments and features of the be present invention are included within the spirit in scope of the invention as expressed in the appended claims.

DESCRIPTION OF EMBODIMENTS OF THE INVENTION

Reciprocating Piston Device With Double Eccentric Drive

Figure 1:
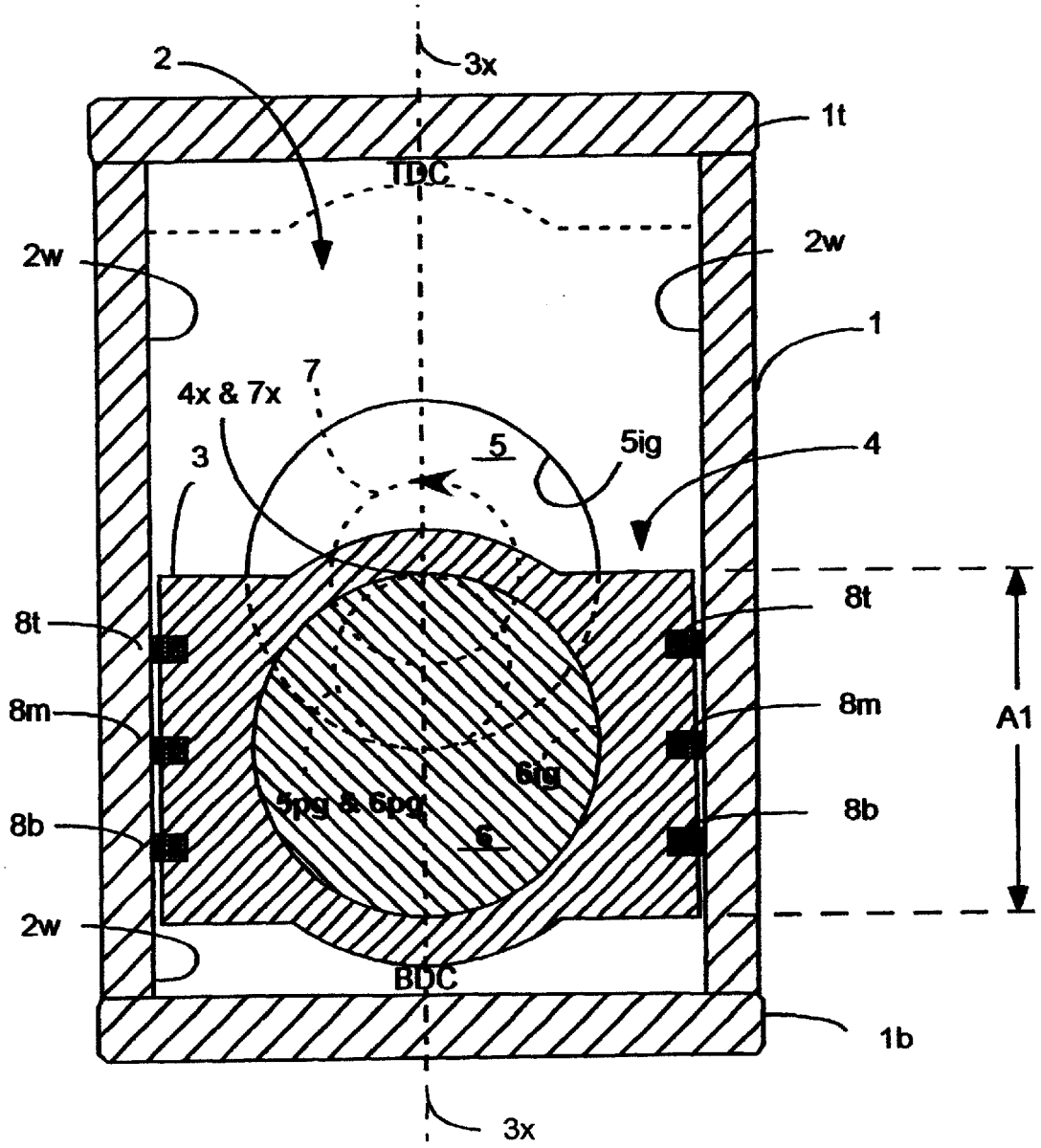
FIG. 1 is a cross-section taken parallel to and through the chamber and piston axis and perpendicular to the double eccentric drive axis, showing the reciprocating devise having a double (major and minor) eccentric drive perpendicular to the piston motion that is caused to rotate by means of a gear train and connected in such a manner as to impart a reciprocating action to the piston in the chamber, the gear ratios of the internal gear to the pinion gear in both the major and minor eccentrics being 2:1, and the position and attitude of the piston is positively controlled by the gears and is independent of the forces between the piston and the chamber wall. The piston and chamber in this example are square or rectangular. Shown are: the chamber head; chamber wall; major eccentric (internal gear); pinion gears; minor eccentric (internal gear); piston strip seals; and the top dead center (TDC) and bottom dead center (BDC) positions of the piston.

FIG. 1 is a diagrammatical cross-section view taken parallel to and through a housing 1, containing the chamber 2, piston 3 and piston axis 3*x*, perpendicular to the double eccentric drive 4 and drive axis 4*x* (into the page).

The reciprocating devise double eccentric drive 4 is perpendicular to the piston motion and consists of: the major eccentric 5, the minor eccentric 6, major eccentric internal gear 5*ig*, minor eccentric internal gear 6*ig*, major eccentric pinion gear 5*pg* and minor eccentric pinion gear 6*pg*, all between the piston 3 and rotating drive shaft7 on axis 7*x* that is attached to major eccentric 5, and all engaging in such a manner as to convert the reciprocating action to the piston 3 in the chamber 2 to the rotating action of the drive shaft 7 and visa versa.

The gear ratios of the internal gear to the pinion gear in both the major and minor eccentrics is 2:1. The position and attitude of the piston 3 in the chamber 2 is positively controlled by the eccentric gears and is independent of the forces between the piston and the chamber wall.

Figure 10:
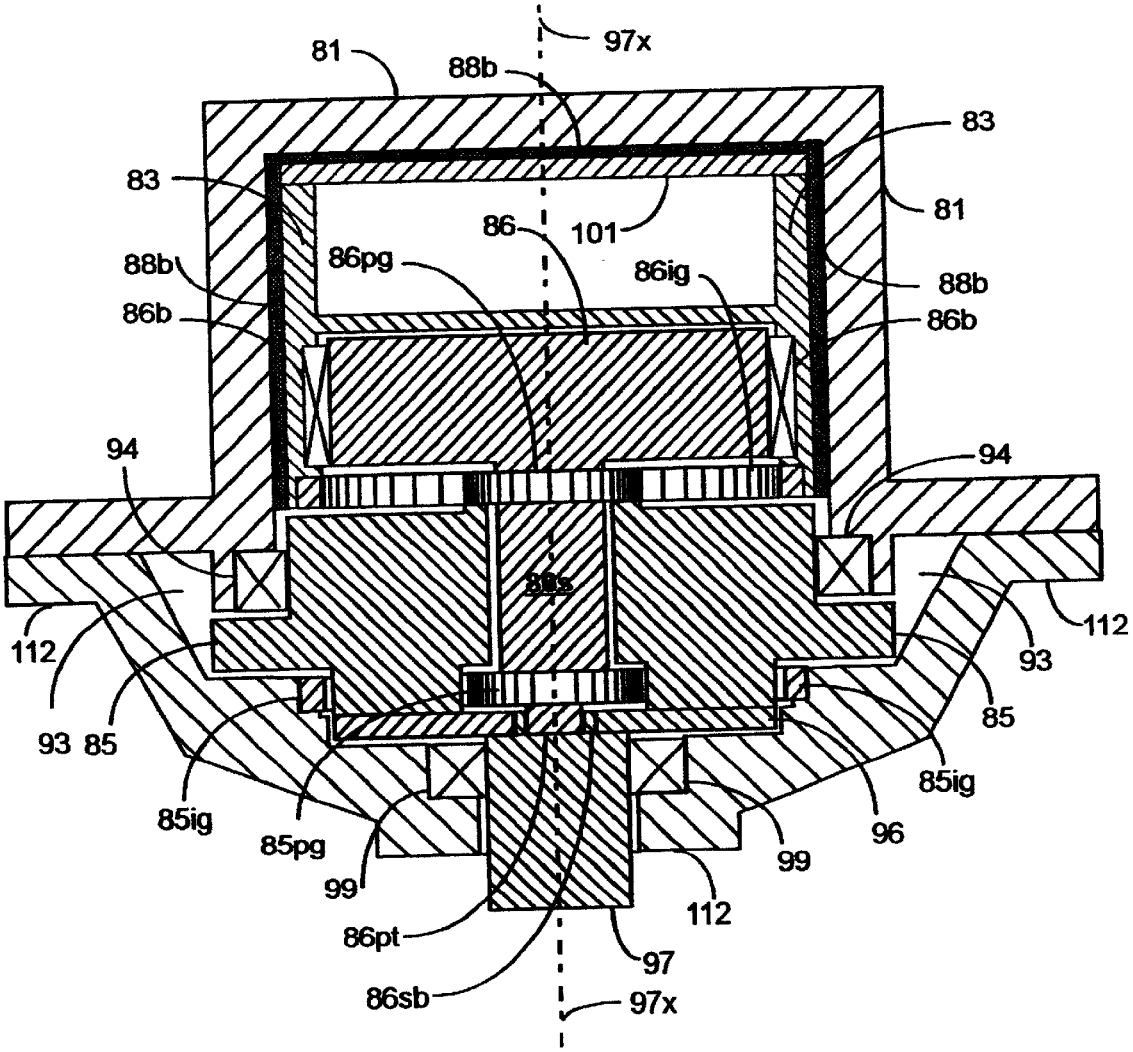
FIG. 10 is a top cross-section view of the two cycle double acting engine of FIGS. 8 and 9, taken as shown in those figures, and showing the rectangular cross-section shape of the piston and chamber which permits shortening the spacing between the major and minor eccentrics, to provide a more compact system.

The piston and chamber in this example are preferably square or rectangular as shown in FIG. 10. Also shown in FIG. 1 are: the chamber heads 1*t* and 1*b*; piston strip seals 8*t*, 8*m* and 8*b*; and the top dead center (TDC) and bottom dead center (BDC) positions of the piston.

Modified Reciprocating Piston Device With Double Eccentric Drive

Figure 2:
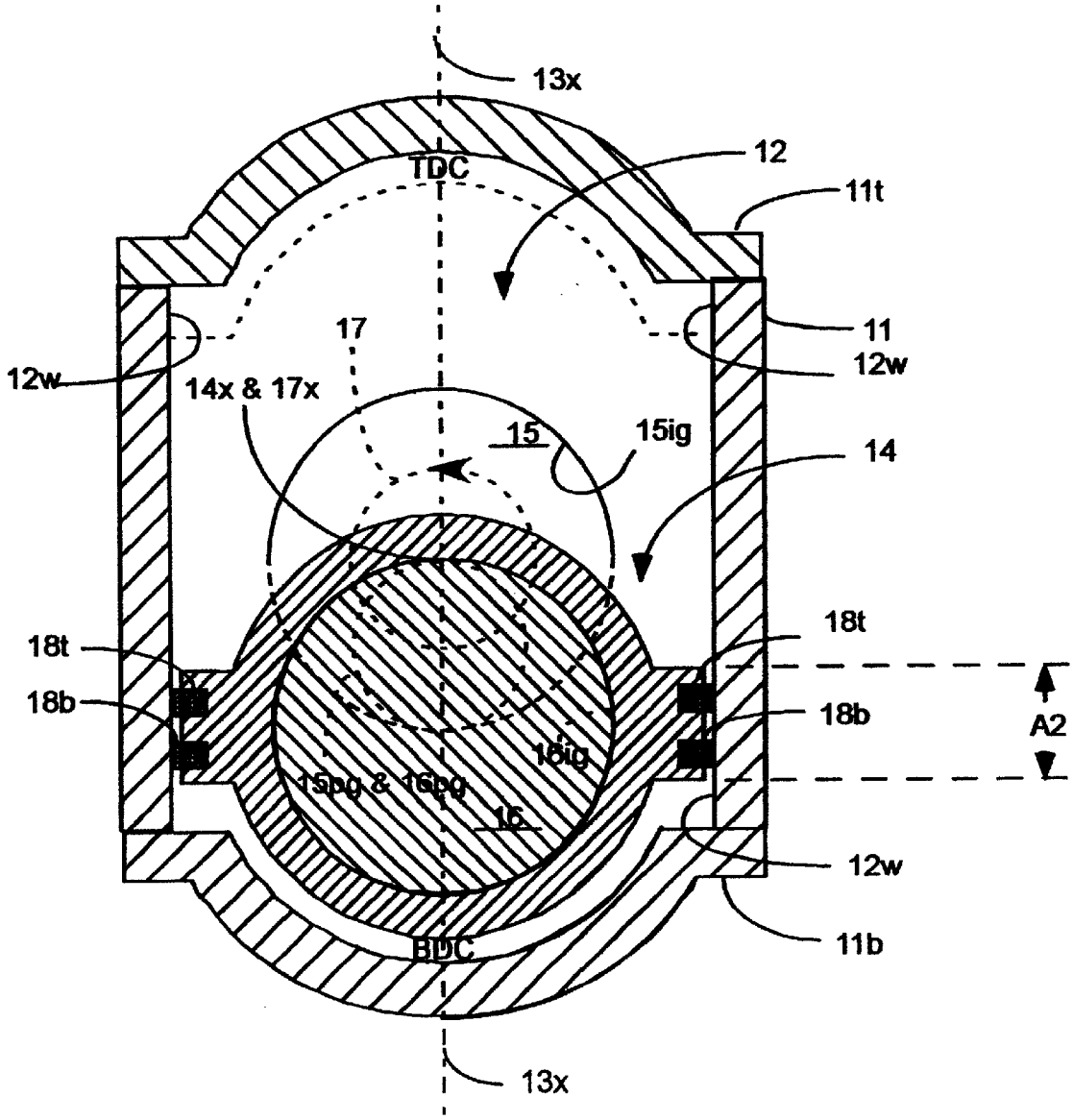
FIG. 2 is a modification of the embodiment shown in FIG. 1 to take advantage of the feature that the position and attitude of the piston is positively controlled and is independent of forces between the piston and chamber wall, allowing the piston length A to be considerably reduced without incurring tipping or tilting of the piston.

FIG. 2 is a diagrammatical modification of the embodiment shown in FIG. 1 to take advantage of the feature that the position and attitude of the piston is positively controlled and is independent of forces between the piston and chamber wall, allowing the piston length A2 to be considerably reduced (as compared to piston length A1 in FIG. 1), without incurring tipping or tilting of the piston.

FIG. 2 shows housing 11, containing the chamber 12, piston 13 and piston axis 13*x*, perpendicular to the double eccentric drive 14 and drive axis 14*x* (into the page).

The reciprocating devise double eccentric drive 14 is perpendicular to the piston motion and consists of: the major eccentric 15, the minor eccentric 16, major eccentric internal gear 15*ig*, minor eccentric internal gear 16*ig*, major eccentric pinion gear 15*pg* and minor eccentric pinion gear 6*pg*, all between the piston 13 and rotating drive shaft 17 on axis 17*x* that is attached to major eccentric 15, and all engaging in such a manner as to convert the reciprocating action to the piston 13 in the chamber 12 to the rotating action of the drive shaft 17 and visa versa.

The gear ratios of the internal gear to the pinion gear in both the major and minor eccentrics is 2:1; the position and attitude of the piston 13 in the chamber 12 is positively controlled by the eccentric gears and is independent of the forces between the piston and the chamber wall; and the piston and chamber in this example are preferably square or rectangular as shown in FIG. 10. Also shown in FIG. 2 are: the chamber heads 11*t* and 11*b*: piston strip seals 8*t* and 8*b*; and the top dead center (TDC) and bottom dead center (BDC) positions of the piston.

Figure 3:
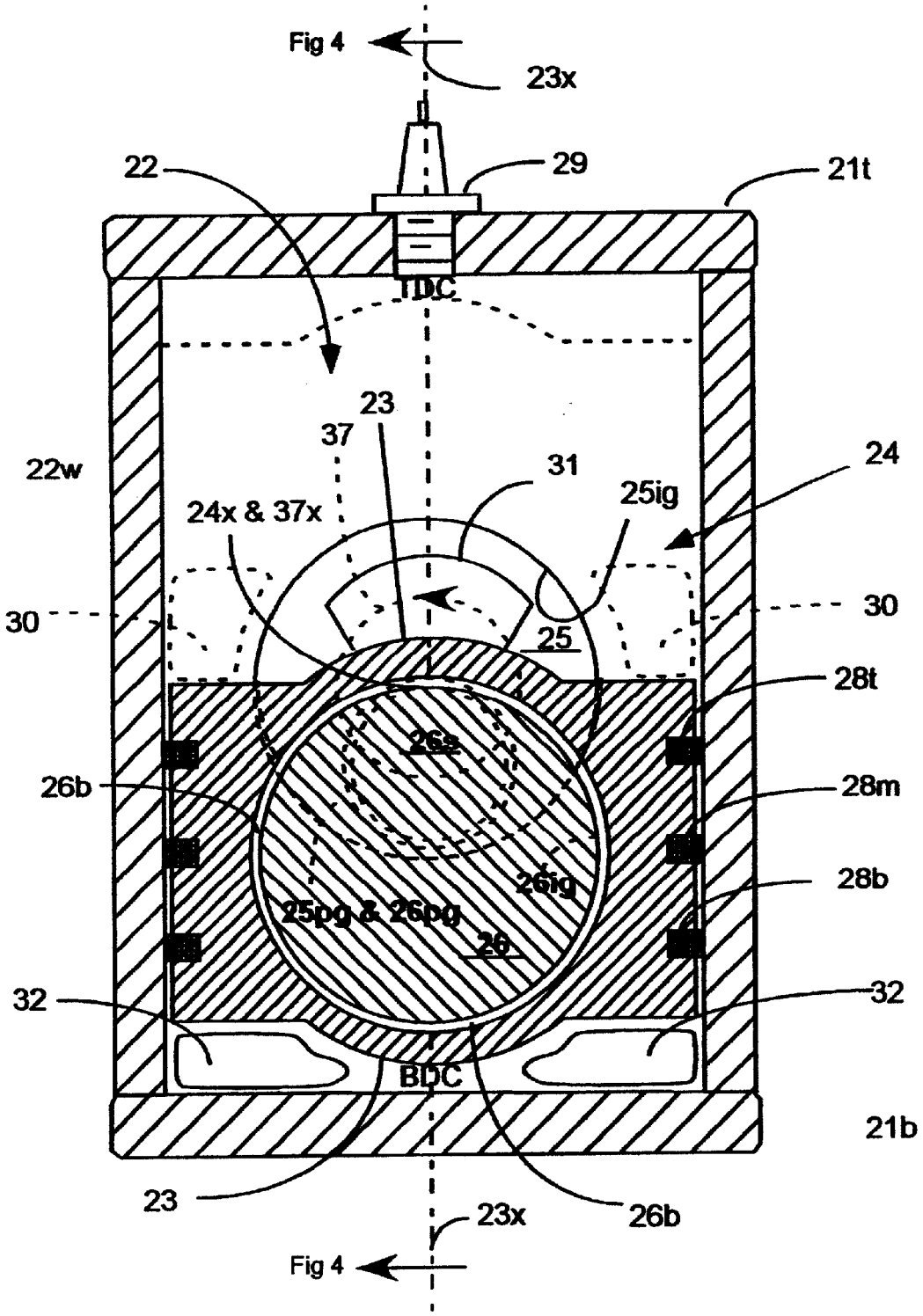
FIG. 3 shows the same view as FIG. 1 with more detail for a two cycle internal combustion engine, further including: spark plug, fixed exhaust port, intake port for scavenging air to the combustion chamber, and the compressed air intake ports at the bottom of the chamber.
Figure 4:
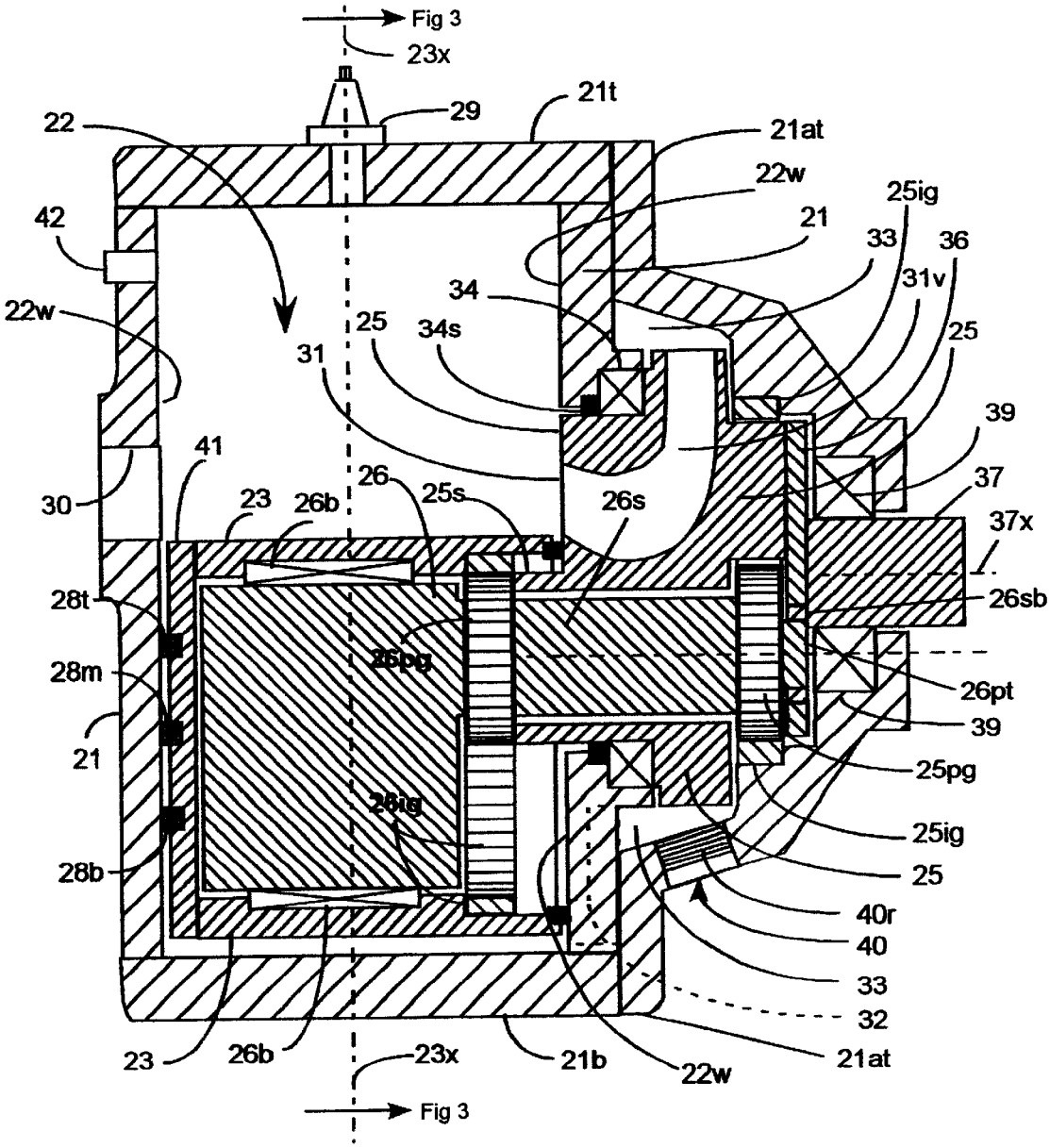
FIG. 4 shows another cross-section view of the two cycle internal combustion engine of FIG. 3 taken parallel through the piston and chamber axis and also parallel through the eccentric drive output shaft, showing the following parts: spark plug, chamber head, air transfer passage, major output bearing, major internal gear, counter weight, major eccentric, output drive shaft, major eccentric cover plate, pinion shaft pintail and bearing, major pinion gear fixed to the minor pinion shaft, air intake to compressor side only (lower air chamber), minor internal gear, piston, piston cover plate, minor eccentric, minor pinion gear affixed to the major eccentric, fixed exhaust port, chamber wall and electronically controlled fuel and air injection port.

Two Cycle Engine With Double Eccentric Output Drive and Rotary Valve in Major Eccentric FIG. 3 shows the same view as FIG. 1, and along with FIG. 4, more detail for a two cycle internal combustion engine in which the piston 23 drives the drive shaft 37, further including: spark plug 29, fixed exhaust ports 30 (shown in phantom line to indicate positions at back of chamber), intake port 31 for scavenging air to the combustion chamber, via rotary valve passage 31*v*, annular passage 33 and the compressed air intake ports 32 at the bottom, as show in FIG. 4.

FIGS. 3 and 4 show housing 21, containing the chamber 22, piston 23 and piston axis 23*x*, perpendicular to the double eccentric drive 24 and drive axis 24*x* and 37*x*.

The reciprocating devise double eccentric drive 24 is perpendicular to the piston motion and consists of: the major eccentric 25, the minor eccentric 26, major eccentric internal gear 25*ig*, minor eccentric internal gear 26*ig*, major eccentric pinion gear 25*pg*, fixed to minor eccentric pinion shaft 26*s*, and minor eccentric pinion gear 26*pg*, fixed to major eccentric 25 at hollow shaft 25*s* thereof, all between the piston 23 and rotating drive shaft 37 on axis 37*x* that is attached to major eccentric 25, and all engaging in such a manner as to convert the reciprocating action to the piston 23 in the chamber 22 to the rotating action of the output drive shaft 37. Minor eccentric 26 is rotatable in piston 23 on bearing 26*b*.

The gear ratios of the internal gear to the pinion gear in both the major and minor eccentrics is 2:1; the position and attitude of the piston 23 in the chamber 22 is positively controlled by the eccentric gears and is independent of the forces between the piston and the chamber wall; and the piston and chamber in this example are preferably square or rectangular as shown in FIG. 10. Also shown in FIG. 3 are: the chamber heads 27*t* and 27*b*; piston strip seals 28*t*, 28*m* and 28*b*; and the top dead center (TDC) and bottom dead center (BDC) positions of the piston.

FIG. 4 is a cross-section view of the two cycle internal combustion engine of FIG. 3 taken parallel through the piston 23 and chamber axis 23*x* and also parallel through the eccentric drive output shaft 37. FIG. 4 also shows the following parts: spark plug 29, chamber heads 21*t* and 21*b*, air transfer passage 33, major output bearing 34, counter weight 35, major eccentric 25, output drive shaft 37, major eccentric cover plate 36, minor eccentric pinion shaft 26*s* and pintail 26*pt* and sleeve bearing 26*sb*, output drive shaft bearing 39, air intake 40 to compressor side only (lower air chamber), through reed valve 40*r*, piston cover plate 41, fixed exhaust port 30, chamber wall and electronically controlled fuel and air injection port 42 and housing attachment 21*at* that is fixed to housing 21 and encloses the major eccentric, output drive shaft and air intakes.

Figure 5:
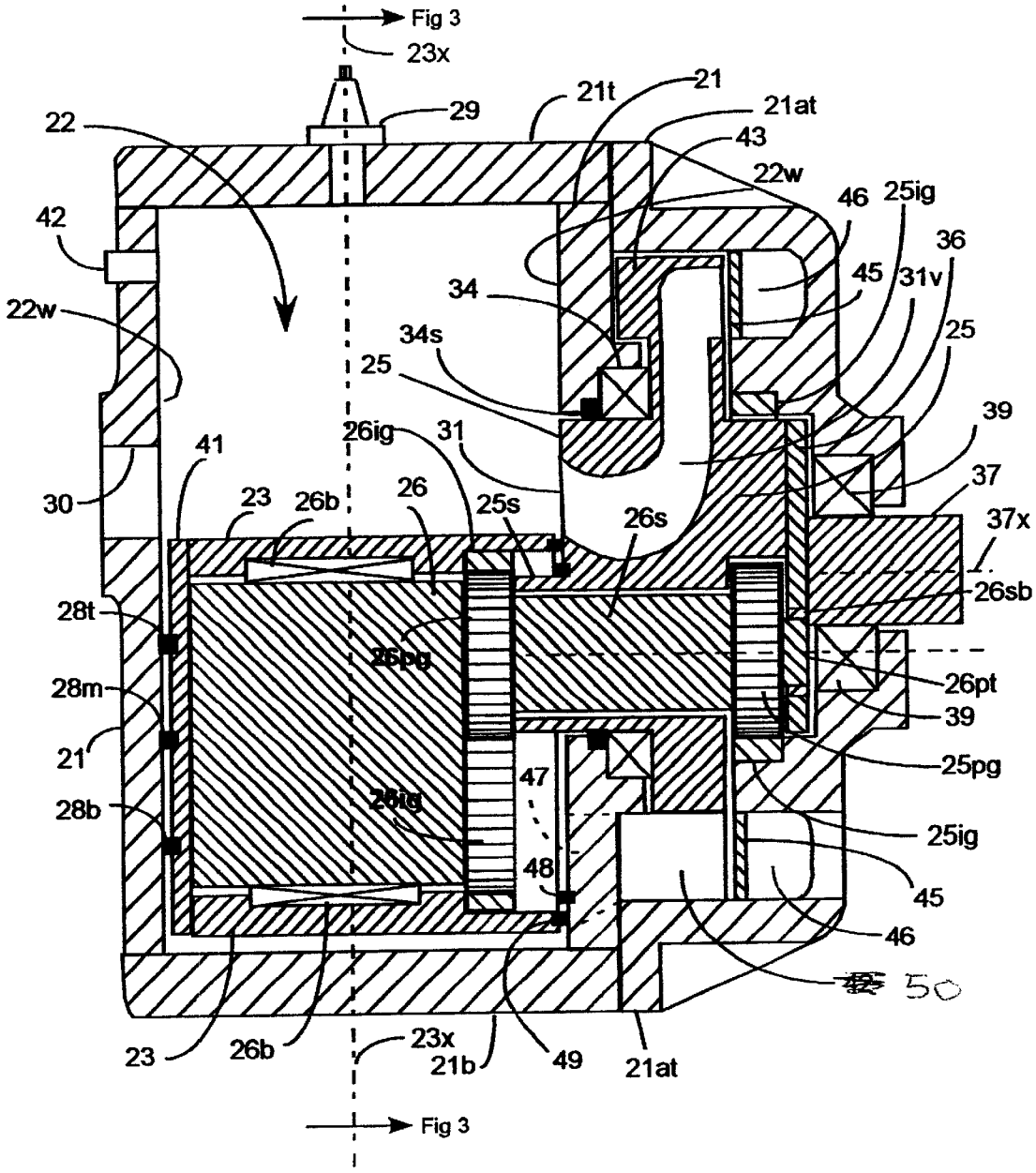
FIG. 5 is the same view of the same two cycle internal combustion engine as in FIG. 4, further including an auxiliary rotary air valve and showing all the same parts as in FIG. 4 with the addition of the auxiliary air valve (compressor end only), combustion chamber, counter weight, air flow from transfer passage, interface plate, annulus, internal ring gear, interface plate, auxiliary air intake port, seal ring and piston seal, internal ring gear.

Two Cycle Engine With Double Eccentric Output Drive, Rotary Valve in Major Eccentric and Auxiliary Rotary Air Valve FIG. 5 is the same view of modified version of the two cycle internal combustion engine as in FIG. 4, further including an auxiliary rotary air valve and showing parts equivalent to parts in FIG. 4 with the addition of the auxiliary air valve 50 (compressor end only), combustion chamber, counter weight 43, air flow from transfer passage 44, interface plate 45, annular air passage 46, auxiliary air intake port 47, seal ring 48 and piston seal 49.

Figure 6:
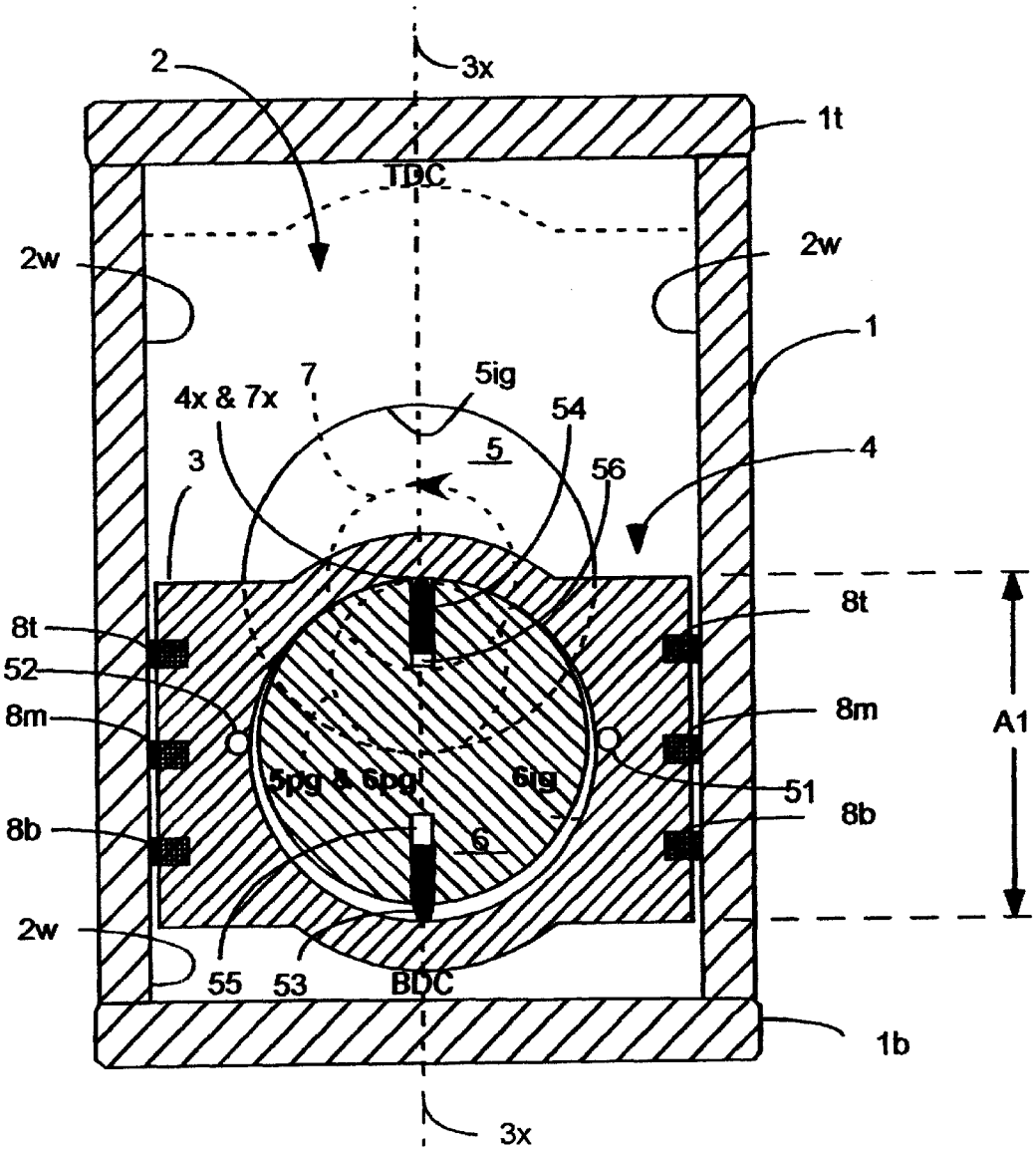
FIG. 6 is the same view as in FIG. 1 of a modified reciprocating devise for two or four cycle engine applications or for fluid pumped motors, showing therein additional structure for integral lube oil pumping (within the minor eccentric) and the accommodations therefore including the following in addition to parts shown in FIG. 1: lube oil suction ports, lube oil discharge (to various engine parts) and sliding vanes at two opposed positions.

Reciprocating Piston Device With Double Eccentric Drive and Oil Pump in Minor Eccentric Driven by Sliding Vanes FIG. 6 is the same view of a reciprocating piston device as in FIG. 1 of a modified reciprocating devise for two or four cycle engine applications or for fluid pumped motors, showing therein additional structure for integral lube oil pumping (within the minor eccentric 6) and the accommodations therefore, including the following in addition to parts shown in FIG. 1: lube oil suction ports 51, lube oil discharge 52 (to various engine parts) and sliding vanes 53 and 54 in slots 55 and 56, respectively, at two opposed positions.

Fluid Motor/Pump With Double Eccentric Output/Input Drive

Figure 7:
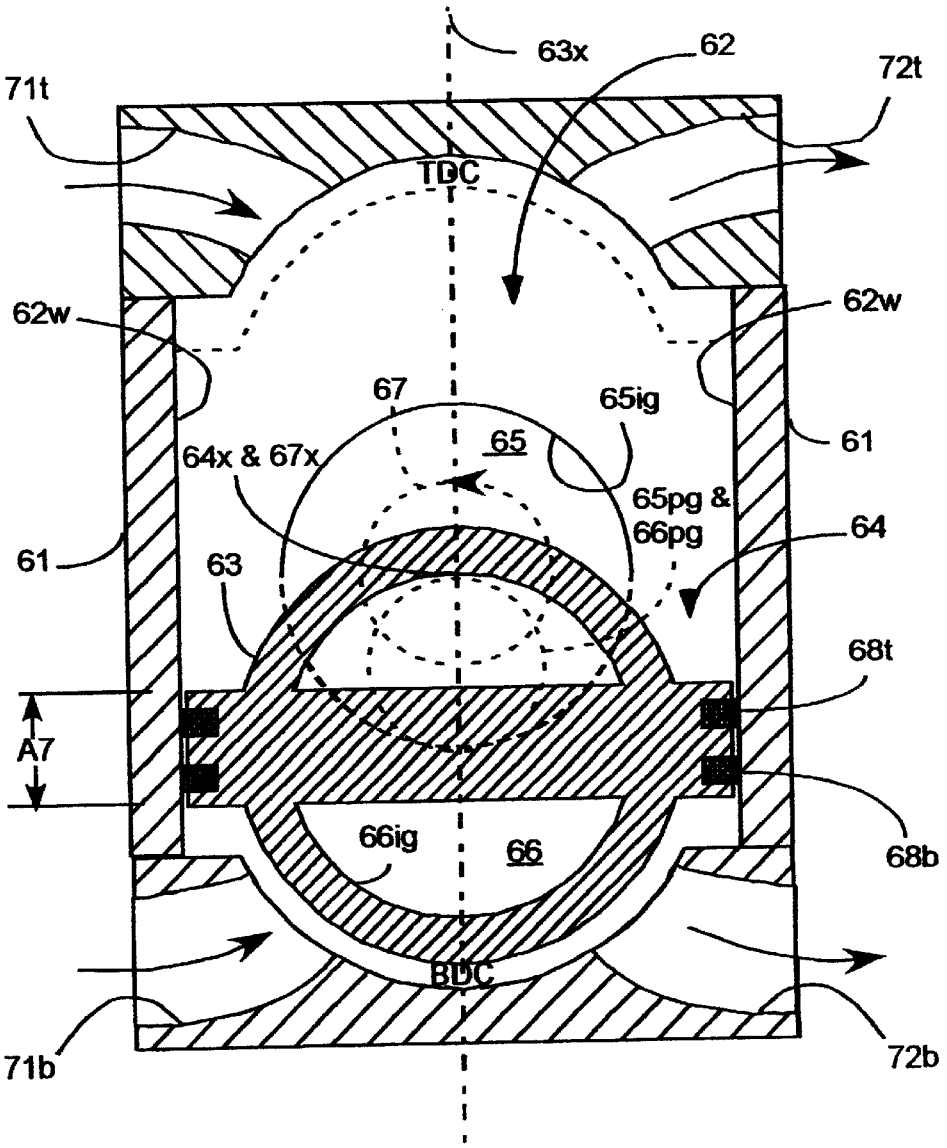
FIG. 7 is the same view as in FIG. 1 of a modified reciprocating devise for fluid pumped motors and pumps, showing therein a different arrangement of intake and discharge ports.

FIG. 7 is a view as in FIG. 2 of a modified reciprocating devise for fluid pumped motors and pumps, showing therein a different arrangement of intake 71*t* and 71*b* and discharge 72*t* and 72*b* ports. Here the view is taken through chamber 62 and piston 63 looking toward all of the double eccentric drive 64.

FIG. 7 also takes advantage of the feature that the position and attitude of the piston is positively controlled and is independent of forces between the piston and chamber wall, allowing the piston length A7 to be considerably reduced without incurring tipping or tilting of the piston.

FIG. 7 shows housing 61, containing the chamber 62, piston 63 and piston axis 63*x*, perpendicular to the double eccentric drive 64 and drive axis 64*x*.

The reciprocating devise double eccentric drive 64 is perpendicular to the piston motion and consists of: the major eccentric 65, the minor eccentric 66, major eccentric internal gear 65*ig*, minor eccentric internal gear 66*ig*, major eccentric pinion gear 65*pg* and minor eccentric pinion gear 66*pg*, all between the piston 63 and rotating drive shaft 67 on axis 67*x* that is attached to major eccentric 65, and all engaging in such a manner as to convert the reciprocating action to the piston 63 in the chamber 62 to the rotating action of the drive shaft 67 and visa versa.

The gear ratios of the internal gear to the pinion gear in both the major and minor eccentrics is 2:1; the position and attitude of the piston 63 in the chamber 62 is positively controlled by the eccentric gears and is independent of the forces between the piston and the chamber wall; and the piston and chamber in this example are preferably square or rectangular as shown in FIG. 10. Also shown in FIG. 7 are: the chamber heads 61*t* and 61*b*; piston strip seals 68*t* and 68*b*; and the top dead center (TDC) and bottom dead center (BDC) positions of the piston.

Figure 8:
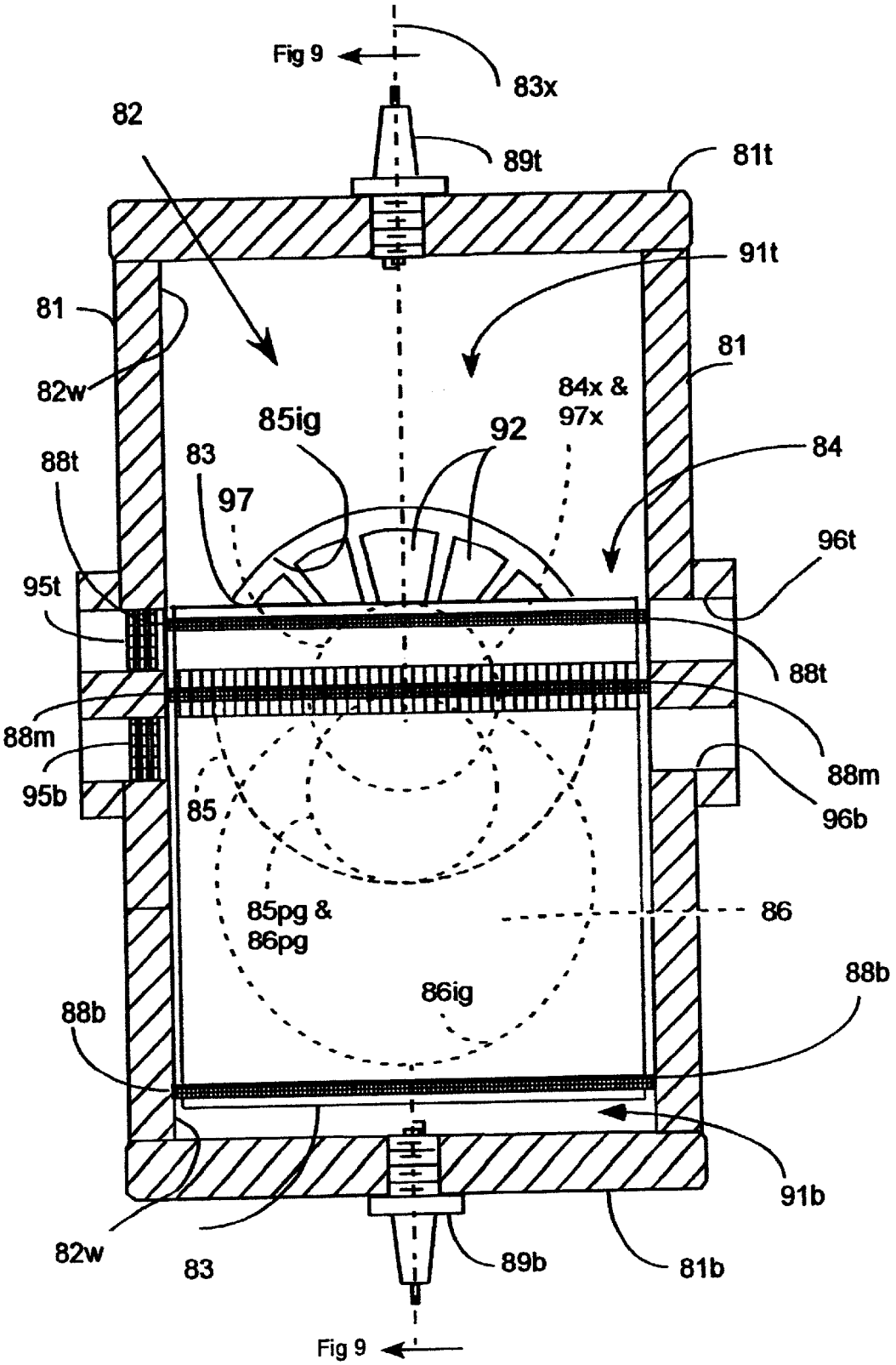
FIG. 8 is a cross-section (like FIG. 1) taken parallel to and through the chamber and piston axis and perpendicular to the double eccentric drive axis, for a two cycle self aspirating engine or a two stage double acting compressor having spark plugs and combustion chambers above (on the top side of) and below (on the bottom side of) the piston and a rotary valve (air transfer passage) positioned by the eccentric drive; and on one side intake reed valves admitting gasoline and air mixture, one for the upper and one for the lower combustion; and on the opposite side porting passages to the rotary valve mixture, one for the upper and one for the lower combustion.
Figure 9:
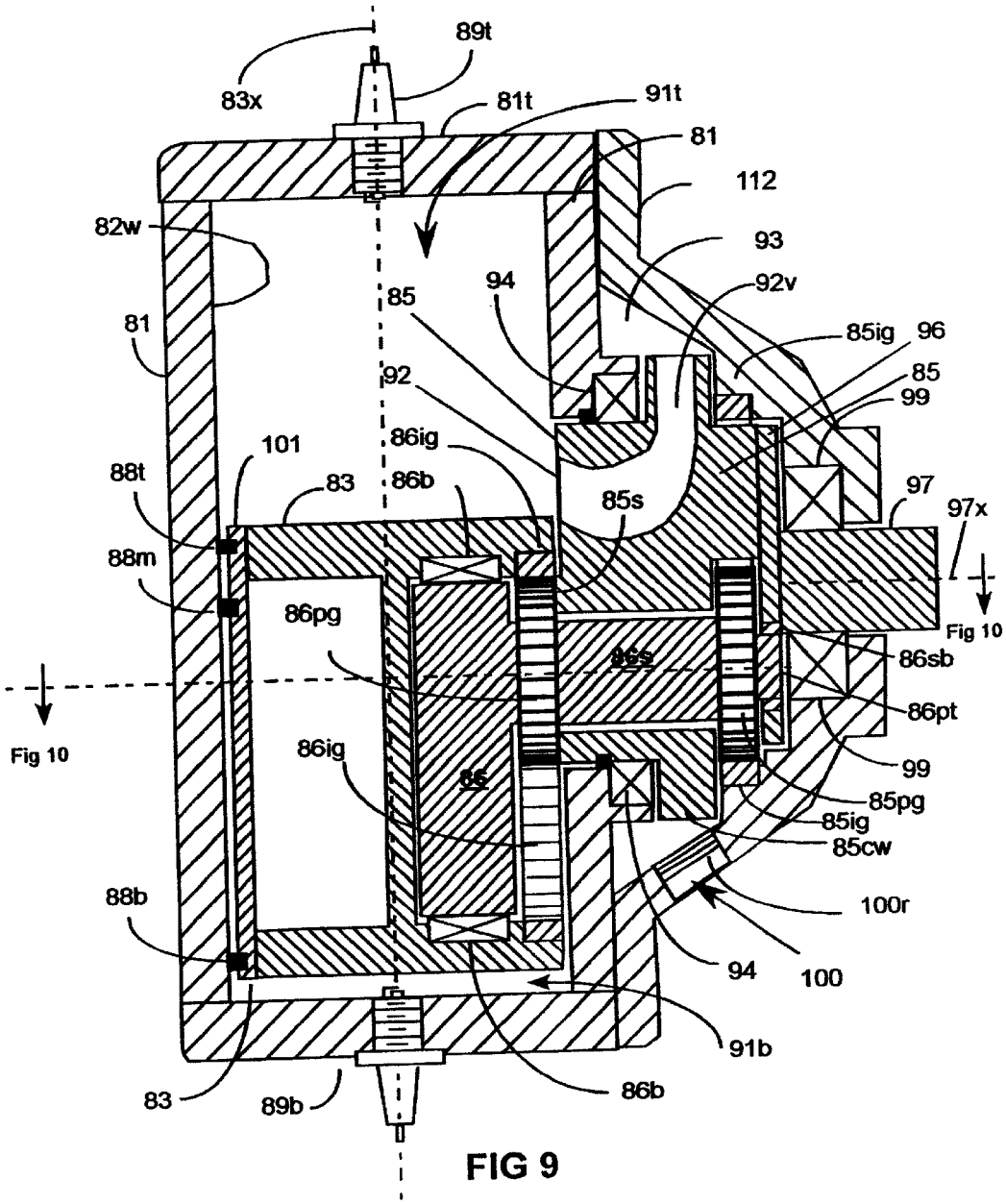
FIG. 9 shows a cross-section view of the same type of two cycle self aspirating engine or two stage double acting compressor having spark plugs and combustion chambers above (on the top side of) and below (on the bottom side of) the piston, as in FIG. 8, the view for this embodiment being taken through the piston and chamber axis and also parallel to and through the eccentrically driven output drive shaft and showing the following parts: two spark plug, two gas and mixture injection ports, two exhaust ports and all of the output drive parts shown in FIG. 4.

Double Acting Two Cycle Engine With Double Eccentric Output Drive, Rotary Valve in Major Eccentric and Auxiliary Rotary Air Valve FIG. 8 is a cross-section (like FIG. 3) taken parallel to and through the chamber, but not through the piston, which is shown full view. The section is along the chamber axis and perpendicular to the double eccentric drive axis 84*x*. FIGS. 8, 9 and 10 show a two cycle, two stage double acting engine having spark plugs 89*t* and 89*b* and combustion chambers 91*t* (on the top side) and 91*b* (on the bottom side), piston 83 and a rotary valve 92*v* (from annular air transfer passage 93) positioned by the eccentric drive 84; and on one side, intake reed valves 95*t* and 95*b* admitting gasoline and air mixture, one for the upper and one for the lower combustion; and on the opposite side exhaust ports 96*t* and 96*b*, one for the upper and one for the lower combustion.

FIGS. 8 and 9 also show: spark plugs 89*t* and 89*b*, housing 81, containing the chamber 82, piston 83 and piston and chamber axis 83*x*, perpendicular to the double eccentric drive 84 and drive axis 84*x*. The engine double eccentric drive 84 is perpendicular to the piston motion and consists of: the major eccentric 85, the minor eccentric 86, minor eccentric bearing 86*b*, major eccentric internal gear 85*ig*, minor eccentric internal gear 86*ig*, major eccentric pinion gear 85*pg* and minor eccentric pinion gear 86*pg*, all between the piston 83 and rotating drive shaft 97 on axis 97*x* that is attached to major eccentric 85, and all engaging in such a manner as to convert the reciprocating action to the piston 83 in the chamber 82 to the rotating action of the output drive shaft 97.

The gear ratios of the internal gear to the pinion gear in both the major and minor eccentrics is 2:1; the position and attitude of the piston 83 in the chamber 82 is positively controlled by the eccentric gears and is independent of the forces between the piston and the chamber wall; and the piston and chamber in this example are preferably square or rectangular as shown in FIG. 10. Also shown in FIGS. 8 and 9 are: the chamber heads 81*t* and 81*b*; piston strip seals 88*t*,

88*m* and 88*b*; and the top dead center (TDC) and bottom dead center (BDC) positions of the piston.

FIG. 9 shows engine of FIG. 8 taken parallel through the piston 83 and chamber axis 83*x* and also parallel through the eccentric drive output shaft axis 97*x*. FIG. 9 also shows: spark plugs 89*t* and 89*b*, chamber heads 81*t* and 81*b*, annular air transfer passage 93, major output bearing 94, counter weight 85*cw*, major eccentric 85, output drive shaft 97, major eccentric cover plate 96, minor pinion shaft 86*s*, with pintail 86*pt* rotatable in sleeve bearing 86*sb* in major cover plate 96, output drive shaft bearing 99, air intake 100 to compressor side only through reed valve 100*r* (lower chamber), piston cover plate 101, and housing attachment 112 that is fixed to housing 81 and encloses the major eccentric 85, output drive shaft 97 and provides air intakes 93 and 100.

FIG. 10 is a top cross-section view of the two cycle double acting engine of FIGS. 8 and 9, taken as shown in those figures, and showing the rectangular cross-section shape of the piston and chamber which permits shortening the spacing between the major and minor eccentrics, to provide a more compact system.

Figure 11:
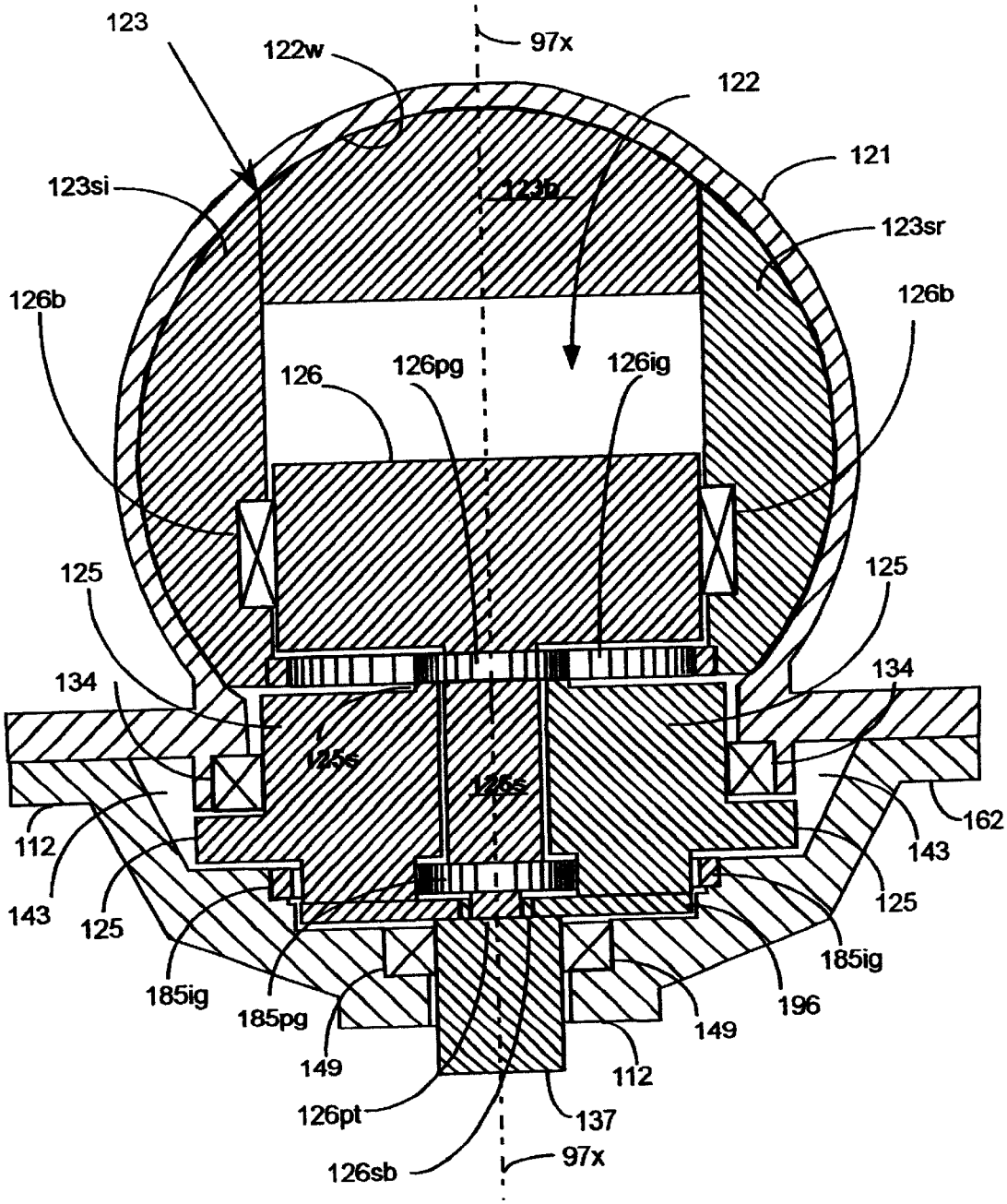
FIG. 11 is a top cross-section view of a two cycle double acting engine similar to the rectangular cross-section engine of FIGS. 8, 9 and 10, taken as shown in those figures, and showing how that engine could be configured having a circular cross-section shape of the piston and chamber, requiring a lengthening of the distance between the major and minor eccentrics as compared to the rectangular cross-section shape.

FIG. 11 is a top cross-section view of the two cycle double acting engine like the engine of FIGS. 8, 9 and 10, taken as shown in those figures, and showing a circular cross-section shape of the piston and chamber requiring a lengthening of the distance between the major and minor eccentrics as compared to the rectangular cross-section shape. In FIG. 11 the piston 123 made of parts 123*b*, 123*si* and 123*sr* that may be a unitary piece, and chamber 122 and chamber axis are perpendicular to the eccentric drive output shaft 137. FIG. 11 also shows the following parts: major eccentric output bearing 134, major eccentric 125, minor eccentric 126 carried in the piston on bearing 126*b* and minor internal gear 126*ig* fixed inside the piston, minor pinion gear 126*pg* fixed to major eccentric 125 at 125*s*, output drive shaft 137, minor eccentric pinion shaft 126*s*, with pintail 126*pt* and sleeve bearing 126*sb* in major cover plate 196, major pinion gear 125*pg* fixed to minor eccentric shaft 126*s* and engaging major internal gear 125*ig* that is fixed inside of housing attachment 162, output drive shaft bearing 149, chamber wall 122*w*. Housing attachment 162 is fixed to housing 121 and encloses the major eccentric 125 and output drive shaft 137.

Schematic Illustrations Of Double Eccentric Action

Figure 12A:
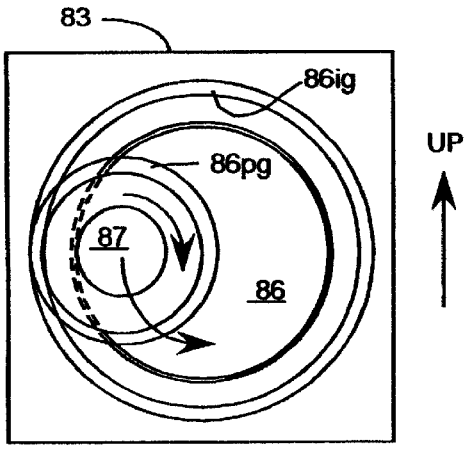
FIGS. 12A, 12B and 12C are schematic diagrams illustrating the positions of parts of the minor eccentric system contained in the piston and the major eccentric system and output drive shaft contained in housing of an engine that also contains the chamber, such as the engine shown in FIGS. 8, 9 and 10, FIG. 12A illustrating the piston and the minor eccentric system carried in the piston when the piston is at the middle positioned between top dead center and bottom dead center, FIG. 12B illustrating the major eccentric system contained in the housing when the piston is at that same position and FIG. 12C illustrating the major eccentric and output drive shaft in the housing for that same piston position.
Figure 13A:
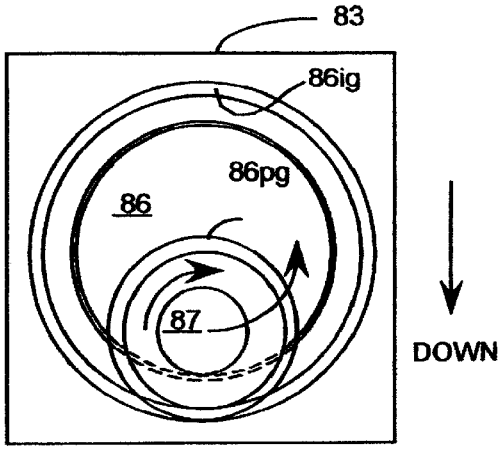
FIGS. 13A, 13B and 13C illustrate the same positions of parts as FIGS. 12A, 12B and 12C, respectively, but at the piston position top dead center to wit.
Figure 12B:
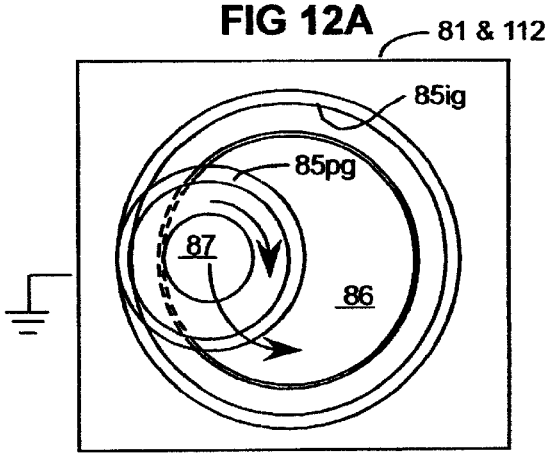
Figure 13B:
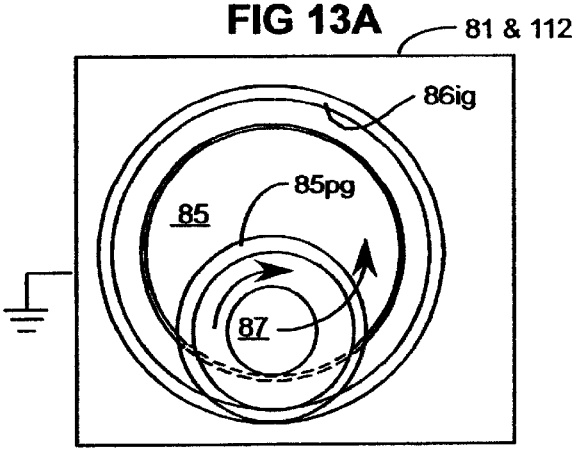
Figure 12C:
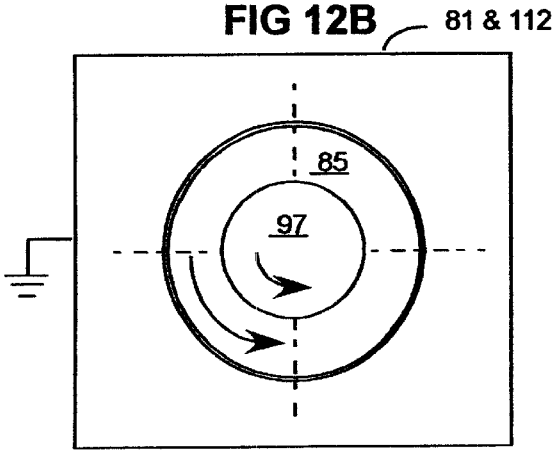
Figure 13C:
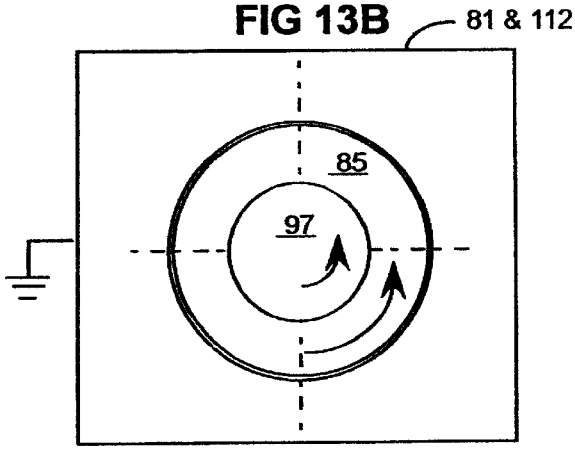

FIGS. 12A, 12B and 12C are schematic diagrams illustrating the positions of parts of the minor eccentric system contained in the piston and the major eccentric system and output drive shaft contained in housing of an engine that also contains the chamber, such as the engine shown in FIGS. 8, 9 and 10, FIG. 12A illustrating the piston and the minor eccentric system carried in the piston when the piston is at the middle positioned between top dead center and bottom dead center, FIG. 12B illustrating the major eccentric system contained in the housing when the piston is at that same position and FIG. 12C illustrating the major eccentric and output drive shaft in the housing for that same piston position;

FIGS. 13A, 13B and 13C illustrate the same positions of parts as FIGS. 12A, 12C and 12C, respectively, but at the piston position top dead center to wit: FIG. 13A illustrates the minor eccentric system carried in the piston when the piston is at top dead center; FIG. 13B illustrates the major eccentric system carried in the housing when the piston is at top dead center; and FIG. 13C illustrates the major eccentric and output drive shaft at that same piston position;

CONCLUSIONS

While the inventions described herein are described in connection with several preferred embodiments, it will be understood that it is not intended to limit the invention to those embodiments. It is intended to cover all alternatives, modifications, equivalents and variations of those embodiments and their features as may be made by those skilled in the art within the spirit and scope of the invention as defined by the appended claims.

What is claimed is:

1. A piston mechanism for internal combustion engines, fluid motors and pumps comprising:

(a) a single piston in a piston chamber wherein said piston is moveable in said chamber on an axis that is common to said piston and said chamber, (b) a rotatable drive shaft that has a drive shaft axis that is perpendicular to said chamber axis (c) a double eccentric drive perpendicular to said piston motion that is caused to rotate by means of a gear train that connects in such a manner to said piston and to said rotatable drive shaft as to convert the reciprocating action of said piston in said chamber to rotation of said drive shaft when said mechanism is a motor and to convert the rotation of said drive shaft to the reciprocating action to said piston in said chamber when said mechanism is a pump, (c) the position and attitude of said piston in said chamber is positively controlled by said gear train and is independent of the forces between said piston and said chamber.

2. The piston mechanism as in claim 1, wherein, (a) said double eccentric drive has major and minor eccentric gears in the ratio of 2:1.

3. The piston mechanism as in claim 1, wherein, (a) said double eccentric drive has major and minor eccentric gears, an output drive shaft, a pinion gear engaging said output shaft and said major eccentric gear, and a pinion gear engaging said minor eccentric gear.

4. The piston mechanism as in claim 3, wherein, (a) said chamber is contained by a housing, (b) said output drive shaft and said major eccentric gear are concentric and are carried by said housing, said output drive shaft being rotatable therein, (c) said minor eccentric gear is carried by said piston and (d) said pinion gears are fixed to a common axle that is carried by said housing.

5. The piston mechanism as in claim 4, wherein, (a) said double eccentric drive has major and minor eccentric gears in the ratio of 2:1.

6. The piston mechanism as in claim 1, wherein, (a) said piston and piston chamber as viewed axially are rectangular.

7. The piston mechanism as in claim 1, wherein, (a) said piston and piston chamber as viewed axially are square.

8. The piston mechanism as in claim 5, wherein, (a) said output drive shaft is perpendicular to a large side of said rectangle

9. The piston mechanism as in claim 7, wherein, (a) said output drive shaft axis of rotation is in the plane that contains the center of said large side of said rectangle.

10. The piston mechanism as in claim 6, wherein, (a) said double eccentric drive has major and minor eccentric gears in the ratio of 2:1.

11. In a piston mechanism for gas driven engines, fluid motors, pumps and the like that has a piston in a chamber that is moveable in the chamber in a reciprocating action and a rotating shaft that is driven by or drives the piston, the improvement comprising, (a) a double eccentric drive mechanically connecting the piston and the drive shaft, (b) the double eccentric drive has a minor eccentric engaged by the minor internal gear that is fixed to the inside of the piston, which converts the piston reciprocating drive motion to an orbiting axle of the minor eccentric and a major eccentric that engages an the major internal gear that is fixed to the outside of the chamber and carries the output drive shaft, and (c) the eccentrics are connected at their orbiting axles so that the major eccentric converts the orbiting motion of the minor eccentric axle to a rotational motion of the drive shaft.

12. The piston mechanism as in claim 11, wherein, (a) said double eccentric drive has major and minor eccentric gears in the ratio of 2:1.

13. The piston mechanism as in claim 11, wherein, (a) the orbiting axle of the minor eccentric and an orbital axle of the major eccentric are connected by gears that engage the minor internal and the major internal gears.

* * * * *